US008171571B2

(12) United States Patent
Utaka

(10) Patent No.: US 8,171,571 B2
(45) Date of Patent: May 8, 2012

(54) GARMENT WITH CROTCH PART AND METHOD OF MAKING THE SAME

(75) Inventor: Shohei Utaka, Kasai (JP)

(73) Assignee: Utax Co., Ltd., Hyogo (JP)

( * ) Notice: Subject to any disclaimer, the term of this patent is extended or adjusted under 35 U.S.C. 154(b) by 317 days.

(21) Appl. No.: 12/294,998

(22) PCT Filed: Mar. 13, 2007

(86) PCT No.: PCT/JP2007/054959

§ 371 (c)(1),
(2), (4) Date: Apr. 26, 2010

(87) PCT Pub. No.: WO2007/119341

PCT Pub. Date: Oct. 25, 2007

(65) Prior Publication Data

US 2010/0210180 A1 Aug. 19, 2010

(30) Foreign Application Priority Data

Mar. 31, 2006 (JP) ..... 2006-096901

(51) Int. Cl.
*A41B 9/04* (2006.01)
*A61F 13/20* (2006.01)

(52) U.S. Cl. ..... 2/406; 2/400; 2/408; 604/385.1

(58) Field of Classification Search ..... 2/400, 403, 2/406, 408; 450/94–96, 102–105, 7, 8, 6, 450/11; 604/385.1, 386, 393, 395, 392, 397, 604/398, 402

See application file for complete search history.

(56) References Cited

U.S. PATENT DOCUMENTS

| | | | | | |
|---|---|---|---|---|---|
| 4,172,002 | A | * | 10/1979 | Gluckin | 156/245 |
| 4,560,381 | A | * | 12/1985 | Southwell | 604/396 |
| 5,447,462 | A | * | 9/1995 | Smith et al. | 450/122 |
| 5,711,034 | A | * | 1/1998 | Cillik | 2/406 |
| 5,916,829 | A | * | 6/1999 | Girard et al. | 442/244 |
| 6,688,943 | B2 | | 2/2004 | Nagaoka | |
| 6,728,973 | B1 | | 5/2004 | Webley et al. | |

FOREIGN PATENT DOCUMENTS

| | | |
|---|---|---|
| JP | 51-52409 | 12/1976 |
| JP | 08-120231 | 5/1996 |
| JP | 10-183405 | 7/1998 |
| JP | 3063342 | 10/1999 |
| JP | 2002-371402 | 12/2002 |
| JP | 2004-060102 | 2/2004 |
| JP | 3097750 | 2/2004 |
| JP | 3101799 U | 6/2004 |
| JP | 3119729 | 3/2006 |

* cited by examiner

*Primary Examiner* — Gloria Hale
(74) *Attorney, Agent, or Firm* — Stites & Harbison PLLC; Douglas E. Jackson

(57) ABSTRACT

A garment with a crotch part according to the present invention is a garment with a crotch pat formed at least by a front body (2) which covers an abdominal, a back body (3) which covers a buttock, and a crotch section (5), wherein an opening (9) is formed at the crotch section (5), and the opening (9) is blocked by joining a godet cloth (12) through heat welding or adhesive. According to such a configuration, the garment with the crotch part according to the present invention is comfortable to wear with the wearing pressure when worn controlled, is able to shape a beautiful lower body, is relatively easy to produce and suited for mass production, and is also inexpensively supplied.

10 Claims, 6 Drawing Sheets

GARMENT WITH CROTCH PART AND METHOD OF MAKING THE SAME

TECHNICAL FIELD

The present invention relates to garments with a crotch part worn in a manner closely attached to a body such as a long girdle, a short girdle, shorts, spats, and a body suit and methods of making the same and, more specifically, to a garment with a crotch part suited for a girdle, spat, and the like for correcting a body shape, and a method of making the same.

BACKGROUND ART

Conventionally, a girdle is known as one of a garment with a crotch part which beautifully corrects and shapes mainly a lower body such as an abdomen, a buttock, and a thigh. The girdle includes a long type with long leg parts and a short type with short leg parts. Such a girdle is normally configured by a front body which covers the abdomen, a back body which covers the buttock, left and right leg parts which cover the thigh, and a crotch section, using a stretchable knitting fabric such as a power net, a satin net, and a two-way tricot. An on-stretchable abdominal patch is arranged at a middle on a front surface of the front body to press down the bulging of the abdomen, and a liner is arranged diagonally upward from the vicinity of the back center part of the lower part of the buttock towards a side to lift up the hip from a lower side thereby shaping a balanced beautiful lower body (see e.g., Patent Document 1).

Patent Document 1: Japanese Registered Utility Model No. 3101799.

However, the girdle of Patent Document 1 involves sewing tasks of each site such as sewing of the front body and the abdominal patch, sewing of the back body and the liner, sewing of the front body and the back body, sewing of the inner edge and the outer edge of the left and right leg parts, and sewing of a godet cloth connecting the front body and the back body, which takes great amount of time and trouble, and thus the production is extremely inefficient and the cost is high. The girdle formed by sewing also has problems in that the wearing pressure is high and thus the feeling when wearing is not satisfactory compared to when the girdle parts are joined with an adhesive and the like.

In particular, at the crotch section, a front end 32*a* of a patch 32 is sewn to a front body 22 and a back end 32*b* of the patch 32 is sewn to a back body 23 on a crotch part cloth 31 so as to be substantially linear in .a width direction respectively, and side edges 32*c*, 32*d* of the patch 32 are sewn to left and right crotch side parts 35*a*, 35*b* of the crotch part cloth 31, as shown in FIG. 1. The sewing line thus projects to a skin contacting surface, whereby an uncomfortable feeling may be felt when worn or a skin disorder may occur, and in addition, the crotch section becomes thick as it is in two layers of the crotch part cloth 31 and the patch 32 and thus the relevant portion appears on the surface when an outer clothing is worn, and the outer appearance becomes improper.

The present invention has been researched and developed in view of solving the above problems, and aims to provide a garment with a crotch part which does not have a pulling feeling or a tightening feeling from sewing, which wearing pressure when worn is controlled so as to be comfortable to wear, which crotch section is thinned so as not to be stuffy, which does not affect the outer clothing and is fashionable and elegant, and which is suited for mass production and can be supplied inexpensively; and a method of making the same.

DISCLOSURE OF THE INVENTION

As means for solving the above problems and achieving the above aim, the present invention developed and adopted a garment with a crotch part formed at least by a front body which covers an abdomen, a back body which covers a buttock, and a crotch section, wherein an opening is formed at the crotch section, and the opening is blocked by a godet cloth joined through heat welding or adhesive.

In the garment with the crotch part configured as described above, the present invention developed and adopted the garment with the crotch part in which an abdominal patch arranged at a middle on a front surface of the front body is joined through heat welding or adhesive to suppress stretchability; the garment with the crotch part in which a circular heated and molded part is formed at the back body; and the garment with the crotch part in which the opening is formed to a substantially tongue-shape in plane.

Furthermore, the present invention developed and adopted a method of making a garment with a crotch part including the steps of obtaining one main cloth cut to a shape covering at least a front body which covers an abdomen, a back body which covers a buttock, and a crotch section; forming cutouts cut inward continuing from a lower end of an abdominal patch of the cut main cloth to outer upper ends of left and right leg parts, and a cutout cut upward from inner upper ends of the left and right leg parts; overlapping and joining the abdominal patch on left and right sides, and inner edges and outer edges of the left and right leg parts; forming an opening of a substantially tongue-shape in plane by assembling the cutouts at the crotch section; and blocking the opening by joining a godet cloth.

In the method of making the garment with the crotch part configured as described above, the present invention developed and adopted a method of making the garment with the crotch part in which the abdominal patch on the left and right sides, and the inner edges and the outer edges of the left and right leg parts are overlapped and joined through heat welding or adhesive to be formed so as to suppress stretchability; a method of making the garment with the crotch part in which the opening formed at the crotch section is formed to a substantially tongue-shape in plane by assembling the cutouts cut inward continuing from the lower end of the abdominal patch to the outer upper ends of the left and right leg parts, and the cutout cut upward from the inner upper ends of the left and right leg parts; and a method of making the garment with the crotch part in which the godet cloth is formed joinable in substantially a plane from a back surface of the opening through heat welding or adhesive.

According to the invention described in detail below, the opening is formed at the crotch section, and the opening is blocked by the godet cloth by joining through heat welding or adhesive, and thus the sewn line is eliminated from the crotch section, the uncomfortable feeling when touching the skin or the occurrence of skin disorder as in the prior art are eliminated, the squeezing feeling and the tightening feeling are eliminated since the entire girdle is joined by heat welding or adhesive and not by sewing, and a comfortable wearing feeling is obtained with the wearing pressure when worn controlled. The crotch section is a single layer and thus is thin and easily fits to the buttock, excels in ventilation thereby preventing stuffiness, and satisfactory appearance is obtained as the godet cloth does not appear on the outer appearance of the outer clothing.

According to the invention described in detail below, the bulging of fat of the abdomen is pressed down, the line of the abdomen is beautifully corrected, and a balanced body shape is obtained by the abdominal patch with suppressed stretchability by joining through heat welding or adhesive.

According to the invention described in detail below, the stretch balance of the fabric with the other portions is adjusted, the hip closely fits to the fabric when worn, the roundness of the hip is beautifully shaped and the shift of the back body is prevented by the circular heated and molded part.

According to the invention described in detail below, the godet cloth is easily joined since the opening is formed to a substantially tongue-shape in plane.

According to the invention described in detail below, the garment with the crotch part that is easy to move can be made in which tasks only performed by skilled person such as sewing with sewing machine are resolved, and the garment with the crotch part worn in a closely attached manner such as a girdle, shorts, spats, and a body suit can be easily made even by beginners since it is configured by one fabric of single raw material and is finished without sewing, and in which the production efficiency is satisfactory and is suited for mass production, the wearing pressure when worn is controlled and the step difference at the joining part is a requisite minimum.

According to the invention described in detail below, the garment with the crotch part can be made that closely fits to the abdomen and the thighs and that shapes the body shape since the abdominal patch and the leg parts are joined through heat welding or adhesive to suppress stretchability.

According to the invention described in detail below, the garment with the crotch part can be made in which an opening of substantially tongue-shape in plane is formed in a relatively easy manner at the crotch section by combining three cutouts of the cutouts cut inward continuing from a lower end of an abdominal patch to outer upper ends of left and right leg parts, and a cutout cut upward from inner upper ends of the left and right leg parts.

According to the invention described in detail below, the garment with the crotch part can be made in which the opening is easily blocked since the godet cloth is formed joinable in substantially a plane from the back surface of the opening.

BEST MODE FOR CARRYING OUT THE INVENTION

Figure 1:
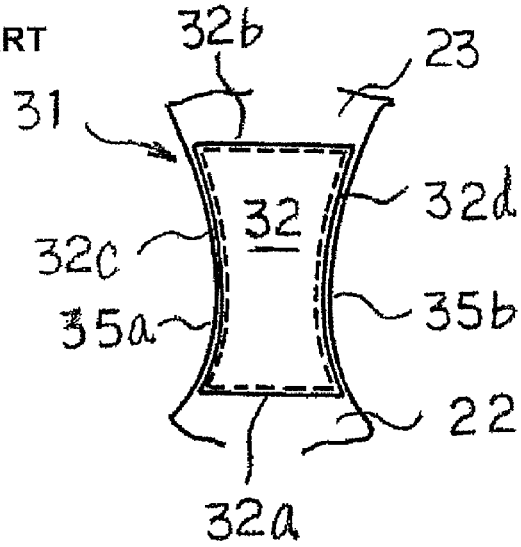
FIGURE 1 PRIOR ART
FIG. 1 is a schematic plan view showing a conventional crotch section.
Figure 2:
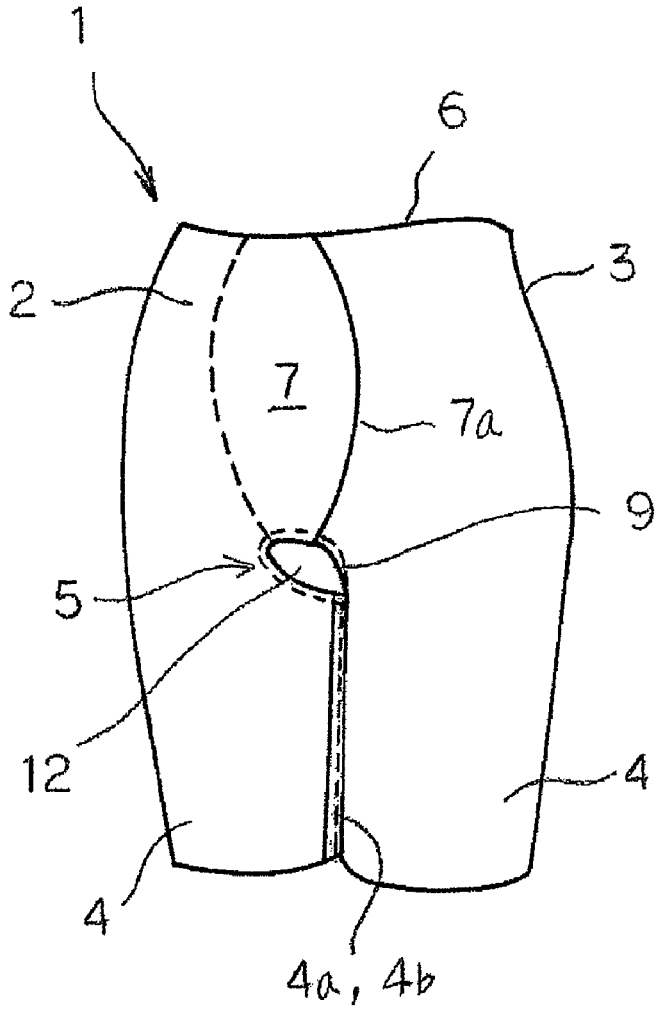
FIG. 2 is a perspective view seen from a front surface side of a long girdle, which is a garment with a crotch part, of the present invention.
Figure 3:
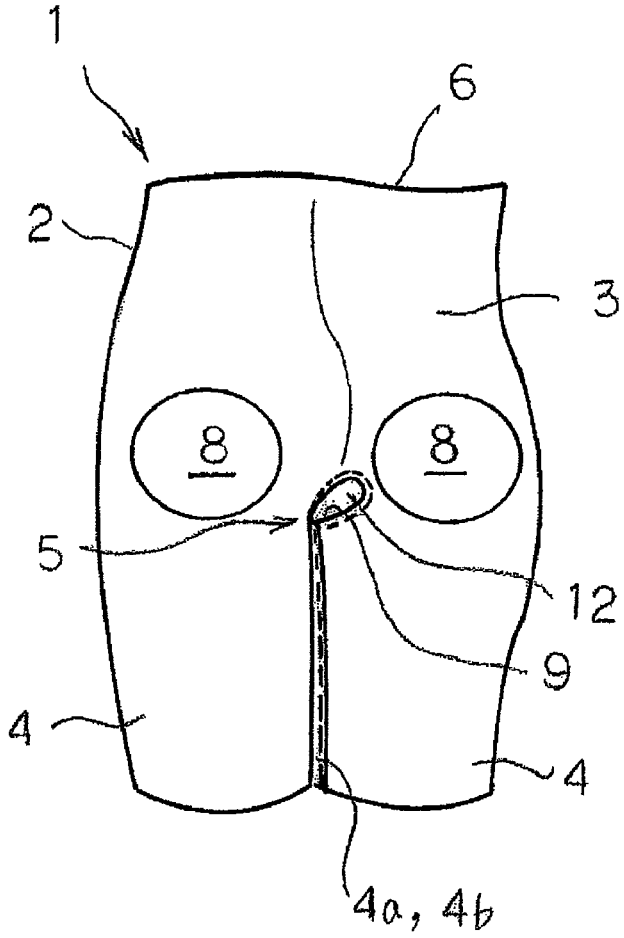
FIG. 3 is a perspective view seen from a rear surface side of the long girdle shown in FIG. 2.
Figure 4:
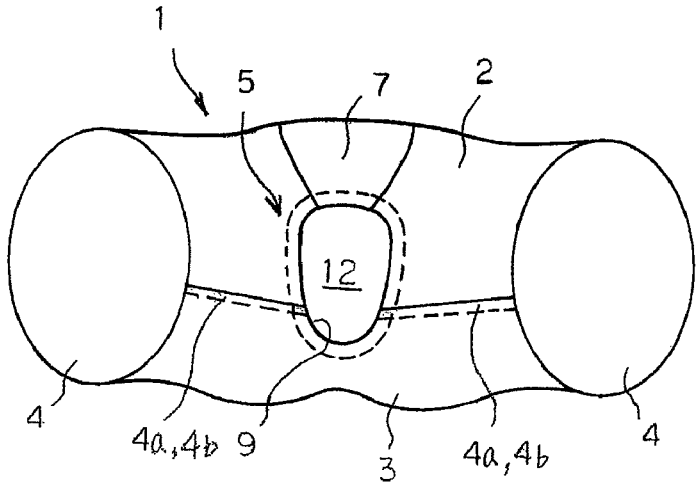
FIG. 4 is an enlarged bottom view seen from a bottom surface side of the long girdle shown in FIG. 2.
Figure 5:
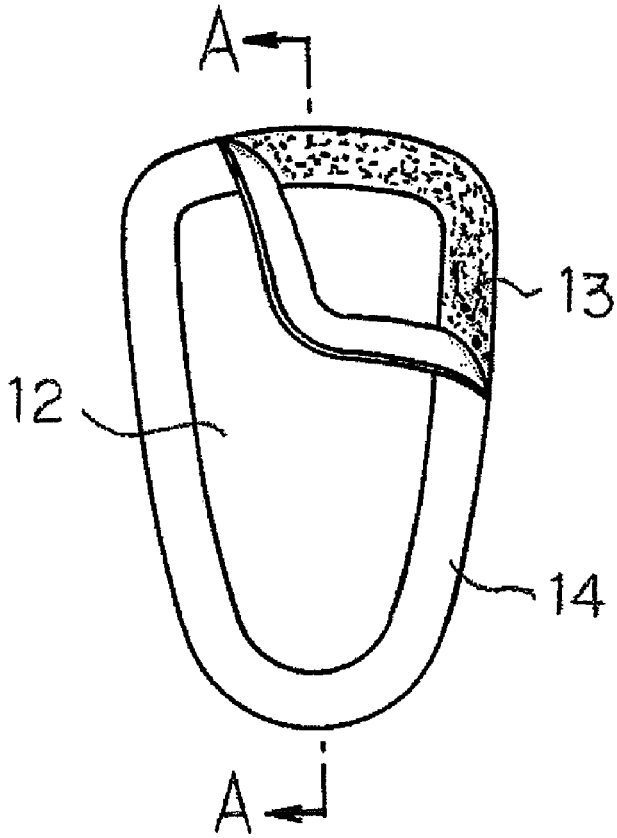
FIG. 5 is an enlarged plan view of a godet cloth.
Figure 6:
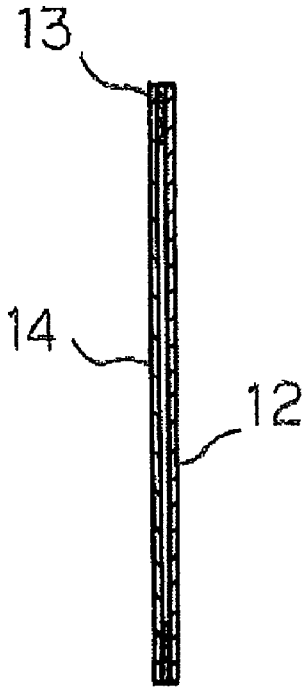
FIG. 6 is a cross-sectional view taken along line A-A of FIG. 5.

An embodiment of the present invention will be described using an example of a long girdle. FIG. 2 is a front perspective view, FIG. 3 is a rear perspective view, FIG. 4 is a bottom view, and FIG. 5 shows a godet cloth, where a girdle 1 is a girdle made of stretchable fabric knitted or woven using nylon, polyurethane fiber, and the like, and the girdle 1 is configured by a front body 2 which covers an abdomen, a back body 3 which covers a buttock, left and right leg parts 4, 4 which cover thighs, and a crotch section 5 which connects the front body 2 and the back body 3 into a series.

Abdominal patches 7, 7 of a length extending from a waist part 6 to the crotch section 5 are arranged at a middle on a front surface of the front body 2 by being joined through heat welding and adhesive. One side edge 7*a* of the abdominal patch 7 is formed to an arc-shaped side that gradually bulges outward from the upper and lower ends and becomes a maximum bulging part at an intermediate part, where the stretch in both directions of a vertical direction and a horizontal direction are suppressed by heat welding and adhesive so as not to stretch.

The left and right leg parts 4, 4 covering the thighs are for the long type but obviously may be for the short type, where an outer edge 4*a* and an inner edge 4*b* are joined through heat welding or adhesive to form the leg parts 4, 4, and the joining part on the inner side is prevented from stretching. A heated and molded part 8 is a circular heated and molded part arranged at the buttock of the back body 3, which heated and molded part 8 enables satisfactory stretchability compared to other portions, and adjusts the stretch balance and creates a beautiful round hip line with the hip projecting outward when the girdle is worn and also prevents the shift of the back body.

Figure 7:
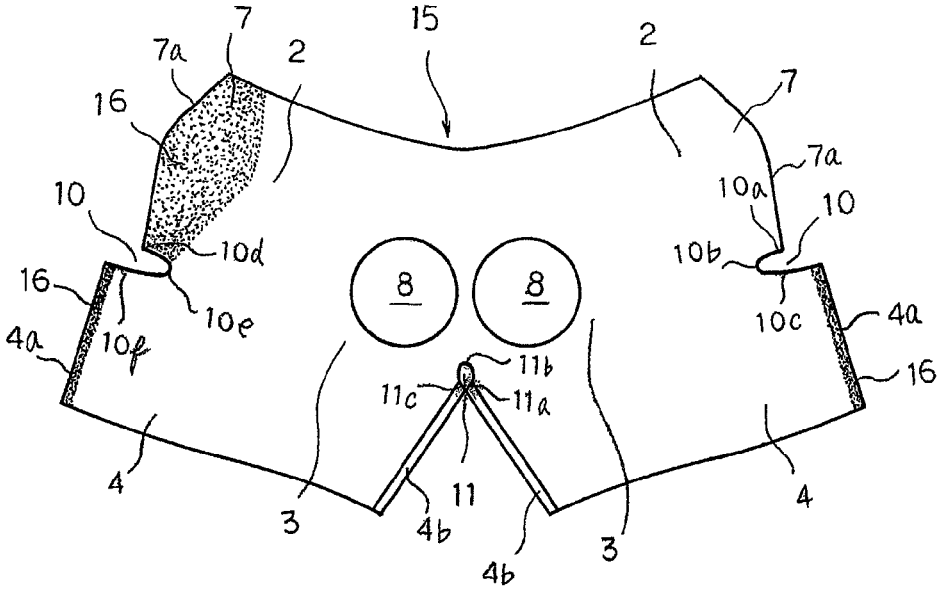
FIG. 7 is an expansion plan view of a long girdle cutting fabric.
Figure 8:
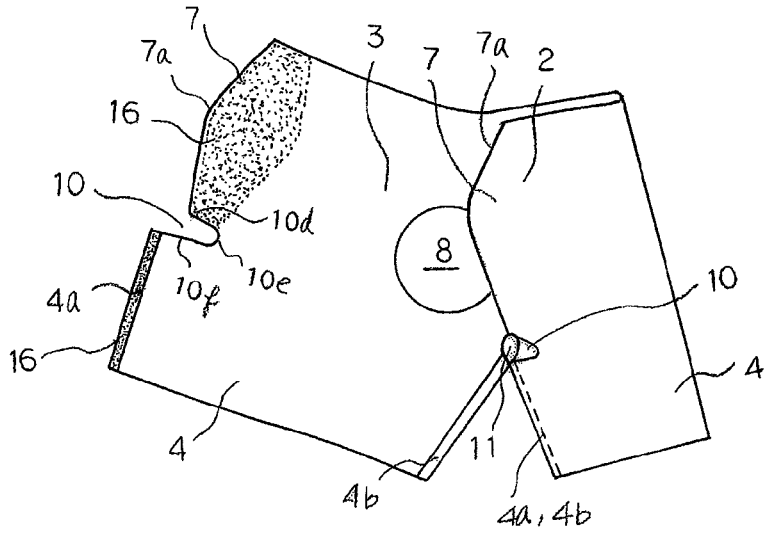
FIG. 8 is a front view of a state in which one side is folded back.
Figure 9:
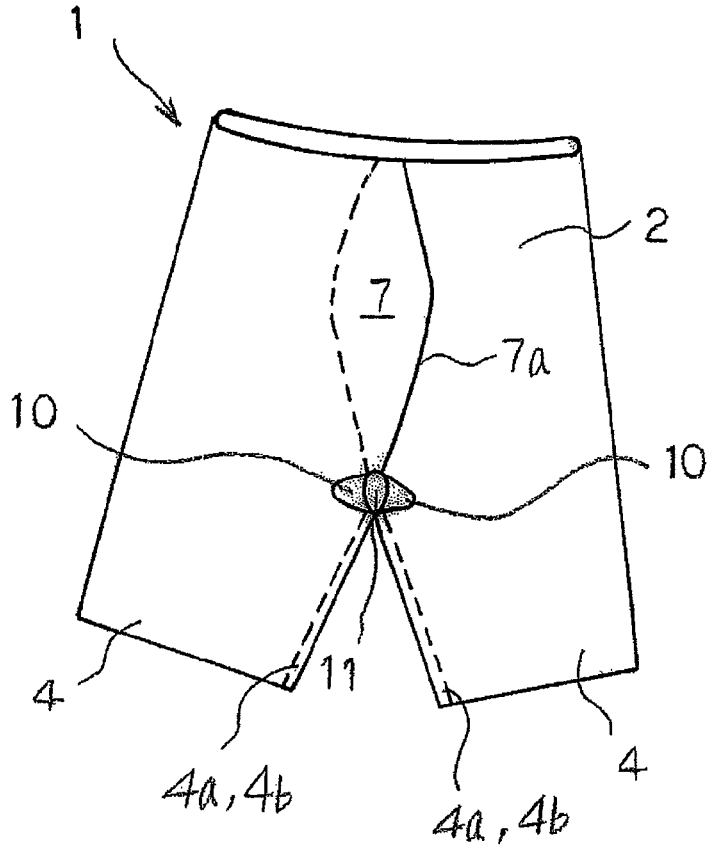
FIG. 9 is a front view of a state in which the other side is folded back and joined.

An opening 9 is an opening having a substantially tongue-shape in plan view formed at the crotch section 5, where such a opening 9 is formed by combining cutouts 10, having a lateral J-shape cut inwardly continuing from the lower ends of the abdominal patches 7, 7 to the outer upper ends of the left and right leg parts 4, 4, and a cutout 11 having a reverse U-shape cut upwardly from the inner upper ends of the left and right leg parts 4, 4, as shown in FIG. 7.

A godet cloth 12 is a godet cloth of stretchable thin fabric which blocks the opening 9, which is made of the same fabric as the front body 2 and the back body 3, which has a substantially tongue-shape in plan view of a size one size larger and of the same shape as the opening 9 as shown in FIG. 5 and is applied with adhesive 13 at the peripheral edge of the surface, and which has a strip paper 14 attached to the upper surface.

The functions and effects of the girdle 1 according to the embodiment configured as described above are that since the opening 9 having a substantially tongue-shape in plan view is formed at the crotch section 5, and the godet cloth 12 made of stretchable thin fabric is joined through heat welding or adhesive 13 to block the opening 9, the overlapping portion is only the peripheral edge and the crotch section 5 is a single layer of only the godet cloth 12, and thus the girdle easily fits along the cleft of the buttock and excels in ventilation thereby preventing stuffiness, eliminates the squeezing feeling and the tightening feeling, and provides a comfortable wearing as the wearing pressure when worn is not high as when sewn since it is joined with adhesive.

A method of making the garment with a crotch part will be described using the long girdle 1 shown in the embodiment above by way of example, where one main cloth 15 cut to a shape covering the front body 2, the back body 3, the left and right leg parts 4, 4, and the crotch section 5 is obtained, as shown in an expansion diagram of FIG. 7. The main cloth 15 uses one knitted fabric of single raw material made of polyurethane fiber such as power net, satin net, and two-way tricot.

At the upper half of the side edges of the cut main cloth 15, the abdominal patches 7, 7 positioned at the middle on the front surface of the front body 2 are formed to arc-shaped strips 7*a*, 7*a* that gradually bulge outward from the upper and lower ends and become the maximum bulging part at the intermediate part. The outer side edges 4*a*, 4*a* of the left and right leg parts 4, 4 are linearly formed at the lower half, the cutouts 10, 10 having a lateral J-shape cut inward of the 10*a*-10*b*-10*c* line and the 10*d*-10*e*-10*f* line continuing from the lower ends of the abdominal patches 7, 7 to the outer upper ends of the left and right leg parts 4, 4 are arranged, and the cutout 11 of reverse U-shape cut upward of the line 11*a*-11*b*-11*c* from the inner upper ends of the left and right leg parts 4, 4 is arranged.

From the expanded state of FIG. 7, the abdominal patches 7, 7 at both side edges are respectively folded inward and overlapped so as to be at the middle of the front body 2, where one abdominal patch 7 is joined to the other abdominal patch 7 with applied hot melt adhesive, adhesive sheet 16 and the like. Thereafter, the abdominal patches 7, 7 are joined with the inner edges 4*b*, 4*b* with the hot melt adhesive, the adhesive sheet 16 and the like applied on the outer edges 4*a*, 4*a* of the left and right leg parts 4, 4. The cutouts 10, 10, 11 are thereby assembled and the opening 9 having a tongue-shape in plan view is formed at the crotch section 5.

Figure 10:
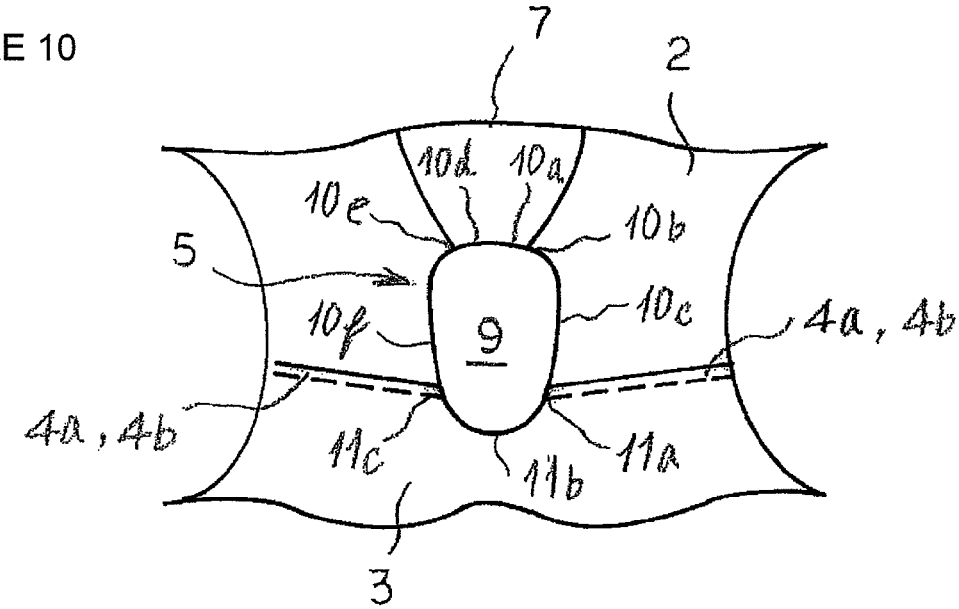
FIG. 10 is a bottom view of a state in which an opening is formed at the crotch section.
Figure 11:
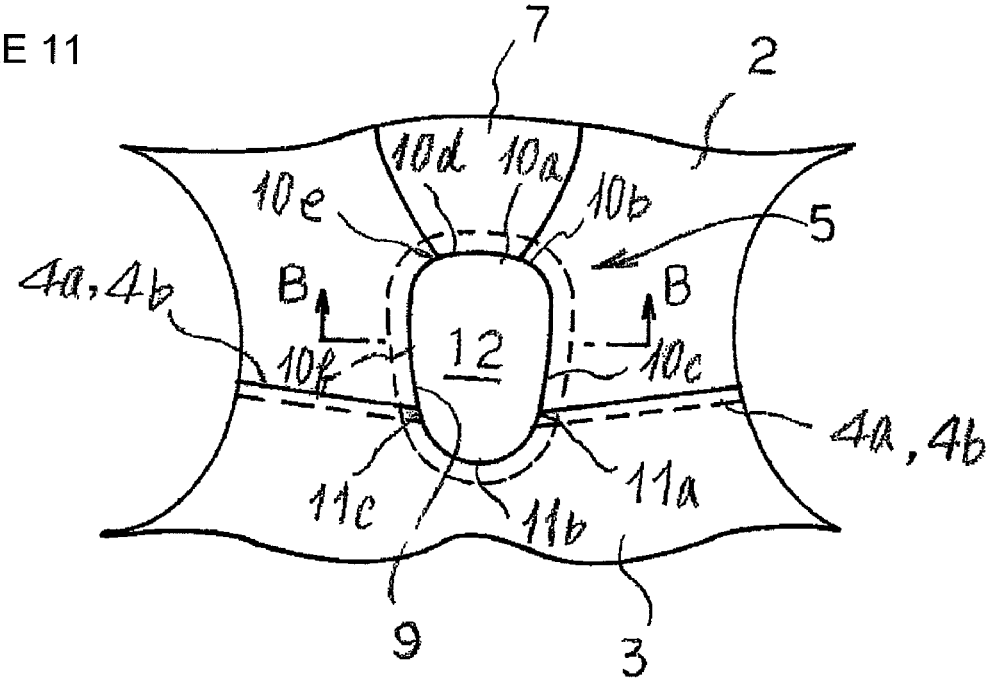
FIG. 11 is a bottom view of a state in which the opening of the crotch section is blocked with the godet cloth.
Figure 12:
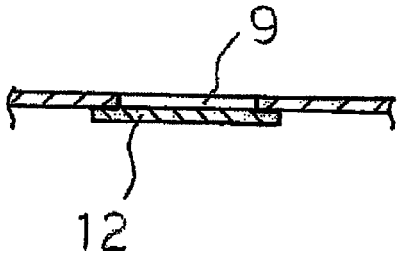
FIG. 12 is a cross-sectional view taken along line B-B of FIG. 11.

In other words, as shown in FIG. 10, the opening 9 of tongue-shape is formed substantially to a plane by arranging one cutout 10 of lateral J-shape including the 10*a*-10*b*-10*c* line on the right side of the front body 2 and the other cutout 10 of lateral J-shape including the 10*d*-10*e*-10*f* line on the left side of the front body 2 so as to be symmetric, and arranging the cutout 11 of reverse U-shape including the 11*a*-11*b*-11*c* on the back body 3.

As described above, the abdominal patch 7 has the two abdominal patches 7, 7 on the left and the right joined with the hot melt adhesive or the adhesive sheet 16 so as to be positioned at the middle on the front surface of the front body 2 and prevented from stretching in the vertical direction and the horizontal direction from the standpoint of pressing down the bulging of fat at the abdomen. The left and right leg parts 4, 4 are suppressed from stretching by joining the inner side with the hot melt adhesive or the adhesive sheet 16 to tighten the thigh and achieve a beautiful line. The circular heated and molded part 8 is arranged at the buttock of the back body 3 so as to fit along the hip, whereby the stretch balance of the fabric with other portions is adjusted and the hip line is corrected beautifully when worn, and the shift of the back body is prevented.

The opening 9 formed at the crotch section 5 is blocked by the godet cloth 12, which has the same shape as the opening 9 and is formed to one size larger than the opening 9 and which is made of a stretchable thin fabric same as the main cloth 15, by being joined from the back side of the opening 9 through heat welding or adhesive.

The functions and effects of the method of making the girdle according to the present embodiment are such that since the girdle is finished by joining through heat welding, adhesive, or the like without being sewn by one fabric of single raw material, the joining locations are few, the stretch balance is even, and the step difference of the abdominal patch and the joining part of the left and right leg parts is formed to a requisite minimum, a girdle in which the wearing pressure when worn is controlled, the wearing feeling is satisfactory, and a beautiful lower body shape is obtained.

The opening 9 formed at the crotch section 5 is formed to a tongue-shape in substantially a plane by arranging one cutout 10 of lateral J-shape on the right side of the front body 2, the other cutout 10 of lateral J-shape on the left side of the front body 2 so as to be symmetric, and arranging the cutout 11 of reverse U-shape on the back body 3, whereby a convenience in that the godet cloth 12 can be joined in plane from the back side of the opening 9 by the applied adhesive 13 is obtained, the joining task is reliably and efficiently performed, mass production can be suitably responded, and lowering in manufacturing cost can be achieved. Furthermore, since the godet cloth is not large and the joining line of the back body and the godet cloth does not reach the edge of the leg insertion opening as in the prior art, a girdle having a satisfactory wearing feeling without roughness touching the skin is efficiently and easily obtained.

The embodiment of the present invention has been described using the example of long girdle, but is not limited thereto, and is not particularly limited as long as it is a garment that can cover at least the abdomen, the buttock, and the crotch part, and may be applied to a body suit and the like. In other words, various design modifications can be made within a scope of achieving the aim of the invention and without departing from the spirit and scope of the invention.

Industrial Applicability

The present invention can be applied to a garment selected from a long girdle, a short girdle, shorts, spats, a body suit, and the like.

The invention claimed is:

1. A garment comprising:

a single main cloth which is cut to shape to provide a) a front body which covers an abdomen of a user, b) a back body which covers a buttock of the user, and c) a crotch section which covers a crotch of the user, said crotch section including a crotch part formed by portions of the front body and the back body, and an opening in the crotch part;

a godet cloth which is shaped to completely cover and block the opening in the crotch; and one of a heat weld or adhesive which joins a peripheral edge of the godet cloth to a periphery of the opening in the crotch part.

2. The garment according to claim 1, wherein the front body includes left and right abdominal patches provided at a middle of the front body and on a front surface of the front body, the left and right abdominal patches overlapping and being joined to one another by any one of a heat weld or adhesive to suppress stretchability of the front body.

3. The garment according to claim 1, wherein the back body includes a left and a right circular part, each of which is located at respective left and right buttocks sections of the back body.

4. The garment according to claim 1, wherein the opening is substantially tongue-shaped in plane.

5. A method of making a garment with a crotch part comprising the steps of:

cutting one main cloth to a shape having at least a front body with left and right abdominal patches, which front body covers an abdomen of a user, a back body which covers a buttock of the user, left and right leg parts having outer upper edges and inner upper edges, which left and right leg parts cover upper portions of left and right legs of the user, and a crotch section which is located at a crotch of the user;

forming left and right cutouts cut inward from a periphery of the main cloth, the left and right cutouts continuing from a lower end of the left and right abdominal patches to outer upper edges of left and right leg parts, and forming a central cutout cut upward from the inner upper edges of the left and right leg parts;

overlapping and joining the left and right abdominal patches and the left and right inner edges and the left and right outer edges of the left and right leg parts;

forming an opening of a substantially tongue-shape in plane with the cutouts at the crotch section as a result of the overlapping and joining step; and blocking the formed opening by joining a godet cloth to a tongue-shaped periphery of the opening formed by the left and right cutouts and by the central cutout to provide a crotch part covering the crotch of the user.

6. The method of making the garment with the crotch part according to claim 5, wherein the overlapping and joining step includes the step of joining the left and right abdominal patches, and of joining the left and right inner edges and the left and right outer edges of the left and right leg parts whereby a type of joining is used which serves to suppress stretchability of the patches and edges.

7. The method of making the garment with the crotch part according to claim 5, wherein the forming of the opening step includes the step of assembling together the left and right cutouts and the central cutout.

8. The method of making the garment with the crotch part according to claim 5, wherein the blocking of the formed opening with the godet cloth step includes the step of any one of heat welding or adhering the godet cloth to the tongue-shaped periphery of the opening.

9. The method of making the garment with the crotch part according to claim 6, wherein the overlapping and joining step and the joining step include the step of any one of heat welding or adhering the patches and inner and outer edges together.

10. The method of making the garment with the crotch part according to claim 7, wherein the assembling step includes the step of any one of heat welding or adhering the cutouts together.

* * * * *